United States Patent [19]
Takanashi et al.
[11] 4,259,610
[45] Mar. 31, 1981

[54] ELECTRON GUN ASSEMBLY FOR CATHODE RAY TUBES AND METHOD OF ASSEMBLING THE SAME

[75] Inventors: Yukio Takanashi, Hiratsuka; Sadao Matsumoto, Kawasaki, both of Japan

[73] Assignee: Tokyo Shibaura Denki Kabushiki Kaisha, Kawasaki, Japan

[21] Appl. No.: 938,978

[22] Filed: Aug. 31, 1978

[30] Foreign Application Priority Data

Sep. 12, 1977 [JP] Japan ..... 52-108945
Dec. 27, 1977 [JP] Japan ..... 52-156502

[51] Int. Cl.[3] ..... H01J 9/18; H01J 29/04; H01J 29/50

[52] U.S. Cl. ..... 313/417; 29/25.15; 313/147; 313/341; 313/457; 313/459

[58] Field of Search ..... 313/459, 270, 341, 457, 313/447, 446, 409, 146, 147, 417, 460; 29/25.15

[56] References Cited

U.S. PATENT DOCUMENTS

| | | | |
|---|---|---|---|
| 2,391,780 | 12/1945 | Hillier | 313/459 X |
| 2,418,317 | 4/1947 | Runge | 313/446 X |
| 2,506,660 | 5/1950 | Blattmann et al. | 313/459 X |
| 3,213,318 | 10/1965 | Glenn, Jr. | 313/147 X |
| 3,441,767 | 4/1969 | Kerstetter | 313/341 X |
| 3,444,416 | 5/1969 | Yoshida et al. | 313/270 |
| 3,541,382 | 11/1970 | Takanashi et al. | 313/270 X |
| 3,643,299 | 2/1972 | Brown | 29/25.5 |

FOREIGN PATENT DOCUMENTS

| | | |
|---|---|---|
| 463241 | 2/1971 | Japan . |
| 4912856 | 5/1972 | Japan . |

*Primary Examiner*—Palmer C. Demeo
*Attorney, Agent, or Firm*—Oblon, Fisher, Spivak, McClelland & Maier

[57] ABSTRACT

An electron gun asembly comprising direct heated cathodes each having an electron emitting member fixed on a filament which is stretched between a pair of support means disposed face to face with each other on a substrate and a plurality of grid electrodes containing first grids, said cathodes and grid electrodes being secured with predetermined distance with one another by insulative support rods. Each of the cathodes has a means adjusting the spacing between the first grid electrode and the electron emitting member.

8 Claims, 30 Drawing Figures

FIG. 1A PRIOR ART
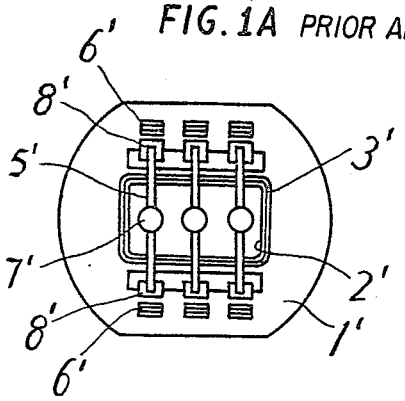
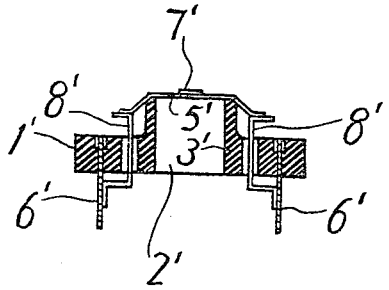
FIG. 1B PRIOR ART

FIG. 8A
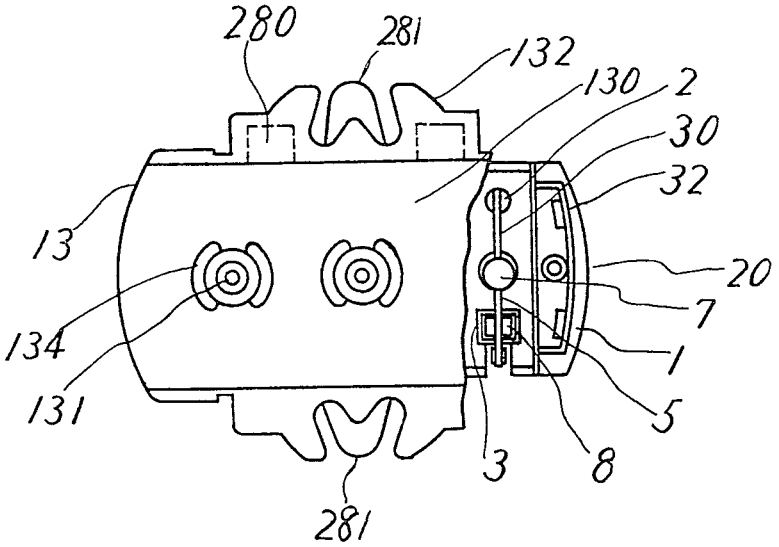
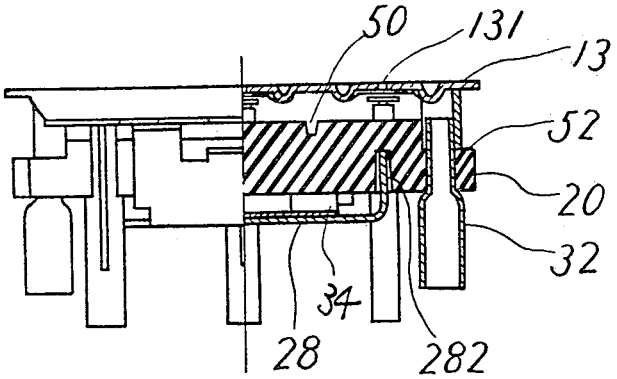
FIG. 8B

FIG. 8C
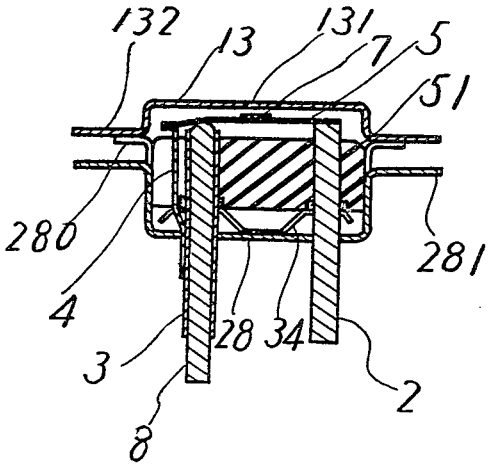
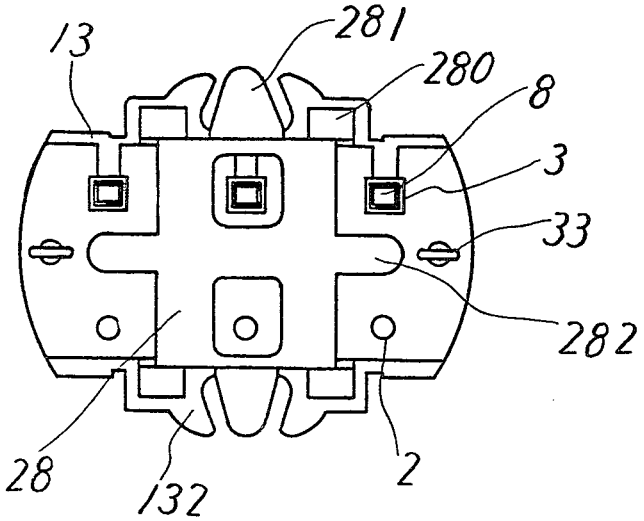
FIG. 8D

FIG. 11A
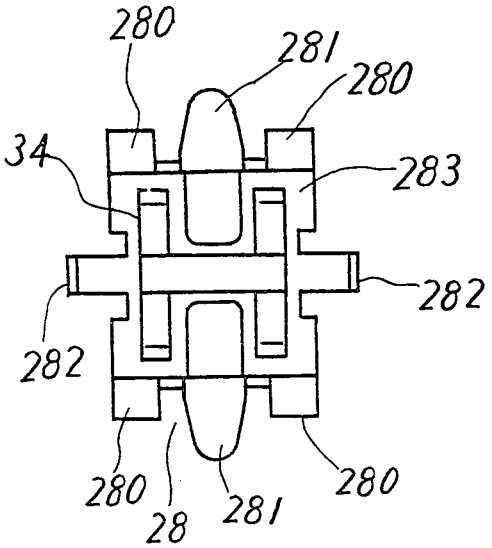
FIG. 11C
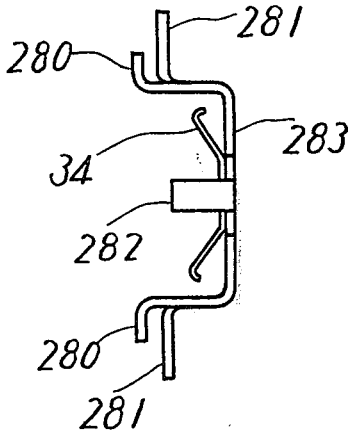
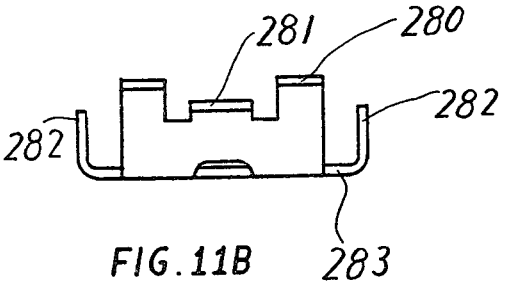
FIG. 11B

FIG. 12A
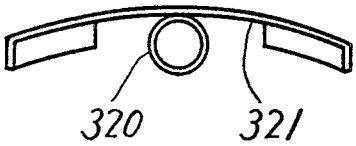
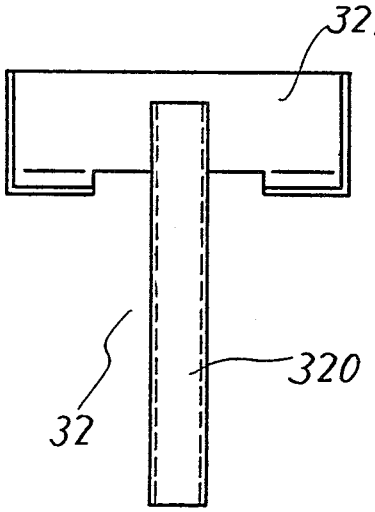
FIG. 12B
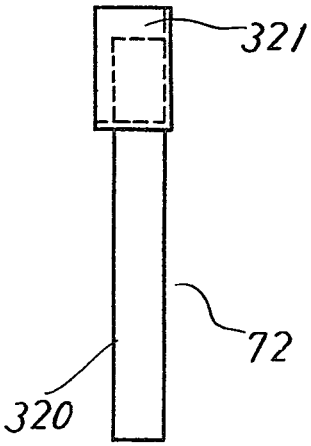
FIG. 12C

ELECTRON GUN ASSEMBLY FOR CATHODE RAY TUBES AND METHOD OF ASSEMBLING THE SAME

BACKGROUND OF THE INVENTION

1. Field of The Invention

This invention relates to an electron gun assembly for cathode ray tubes and method of assembling the same, and more particularly to an electron gun assembly having direct heated cathodes.

2. Brief Description of The Prior Art

Recently, low power consumption property is desired for a cathode ray tube of a TV receiver. To reduce the power consumption, it is planned to lower the deflection power or the cathode heating power of the cathode ray tube.

Especially in a color cathode ray tube having a three-electron-gun assembly, the neck portion of the tube, in which the electron gun assembly is installed, must be thin to reduce deflection power. Consequently the thickness of the gun assembly becomes small and the spaces between respective guns become narrow. The three electron gun assembly is composed of a first grid electrode, a second grid electrode, a third grid electrode, a fourth grid electrode and three cathodes, all of which are secured by glass rods with predetermined distances to each other. Such a narrow three-electron-gun assembly is what is called a unitized gun. Therefore, corresponding electrodes of three electron gun units are equipotential. Accordingly, input signals to the three electron guns are applied to respective cathodes. Consequently, the spacing between the cathode and the first grid electrode in each gun unit must be accurate.

One example of a direct heated cathode used for electron guns of a color cathode ray tube is shown in FIG. 1A and 1B. Reference numeral 1' denotes a plate-like insulative support member made of ceramics and having an aperture 2 at the center portion thereof. At the periphery of the aperture 2' is integrally formed an annular convexity. Three heaters 5 are stretched on the annular convexity equally apart from each other. At the center of each heater 5 is secured an electron emitting member 7'. Both ends of the heater 5' are supported by two resilient ribbons 8' secured to a lead terminals 6' fixed to the support member 1'. These constitute three direct heated cathodes. Furthermore the direct heated cathodes are combined with a plurality of grid electrodes (not shown) with glass rods to construct a three-electron-gun assembly.

It is difficult to set the distances between the cathode and the respective electrodes when these electrodes are assembled. Particularly in an electron gun in which three input signals are applied to three cathodes respectively, the spacing between the electron emitting member and the first grid must be exactly adjusted to the predetermined value in each gun unit. However, conventional gun structure is hard to adjust exactly the spacing.

SUMMARY OF THE INVENTION

Accordingly, an object of the present invention is to provide an electron gun structure having an accurate spacing between an electron emitting member and a first grid electrode. The present invention is based on the fact that a cathode structure comprising an adjusting means to adjust the spacing between an electron emitting member and a first grid electrode disposed near the electron emitting member is useful to correct the error of the spacing.

According to the present invention an adjusting means to adjust the spacing between an electron emitting member positioned at the center of a filament stretched over a substrate by a pair of support members and a first grid electrode to a predetermined value is provided. The adjusting means is provided at one of the support members and comprises a movable member to move the electron emitting member to a predetermined position, a resilient member connected to one of the filaments and a guide member guiding the movable member when it moves.

The present invention therefore provides an electron gun structure for a cathode ray tube comprising a plurality of grid electrodes containing a first grid electrode distant from each other at a predetermined distance and a plurality of direct heated cathodes, wherein each of the cathodes comprises a pair of support members disposed face to face with each other, a filament stretched between the support members, an electron emitting member and an adjusting means to adjust accurately and maintain the spacing between the electron emitting member and the first grid electrode.

The invention may be more clearly described hereinafter with reference to the attached drawings. In the drawing, the same numerals show same or equivalent parts of the constructions.

BRIEF DESCRIPTION OF THE DRAWINGS

In the drawing,

FIGS. 1 (A) and (B) show respectively a plan view and elevational sectional view of a known type direct heated cathode provided for an electron gun of cathode ray tube;

FIGS. 8 (A), (B), (C) and (D) show respectively a top view, partly eliminated elevational view, vertical cross sectional view and bottom view of the essential part of the electron gun of FIG. 7;

FIGS. 11 (A), (B) and (C) show respectively a plan, elevational and side view of a retainer;

FIGS. 12 (A) and (B) show respectively a plan and elevational view of a $G_1K$ spacer;

DETAILED DESCRIPTION OF THE PREFERRED EMBODIMENTS

Figures 2A, 2B:
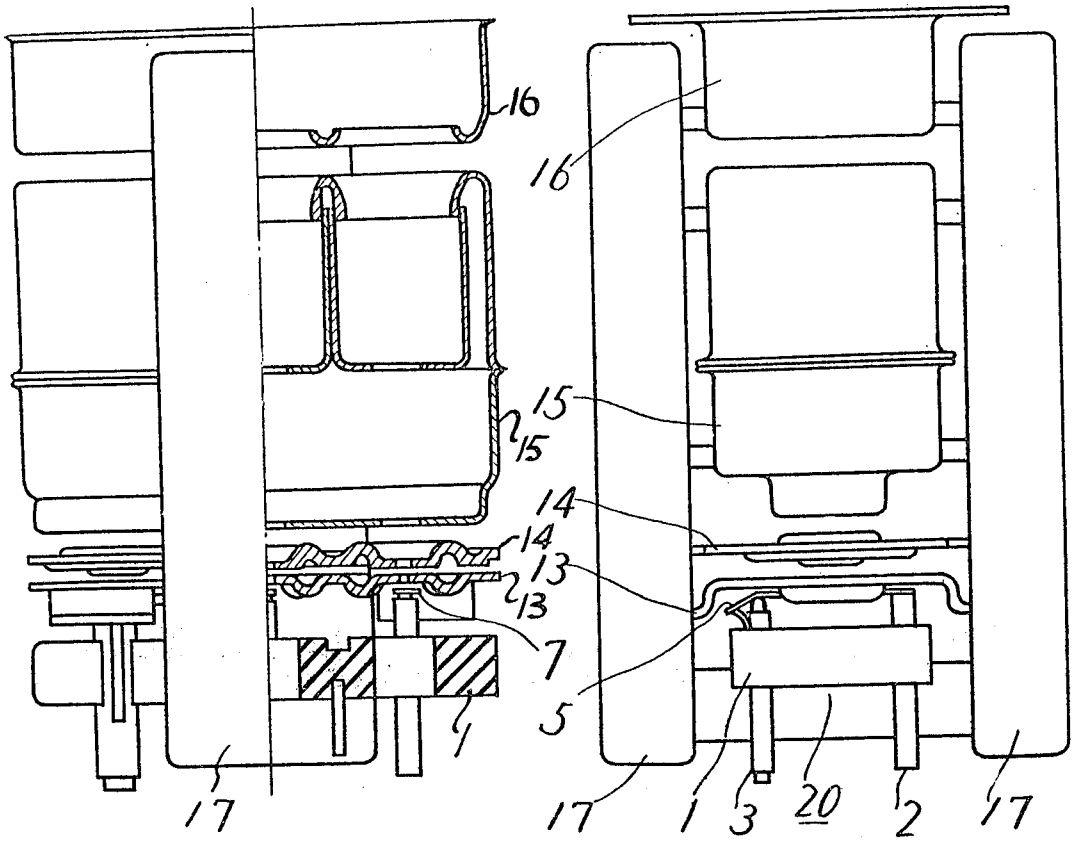
FIG. 2B PRIOR ART
FIG. 2A PRIOR ART
FIGS. 2 (A) and (B) show respectively a partly eliminated elevational view and a side view of an electron gun according to the present invention.
Figure 3:
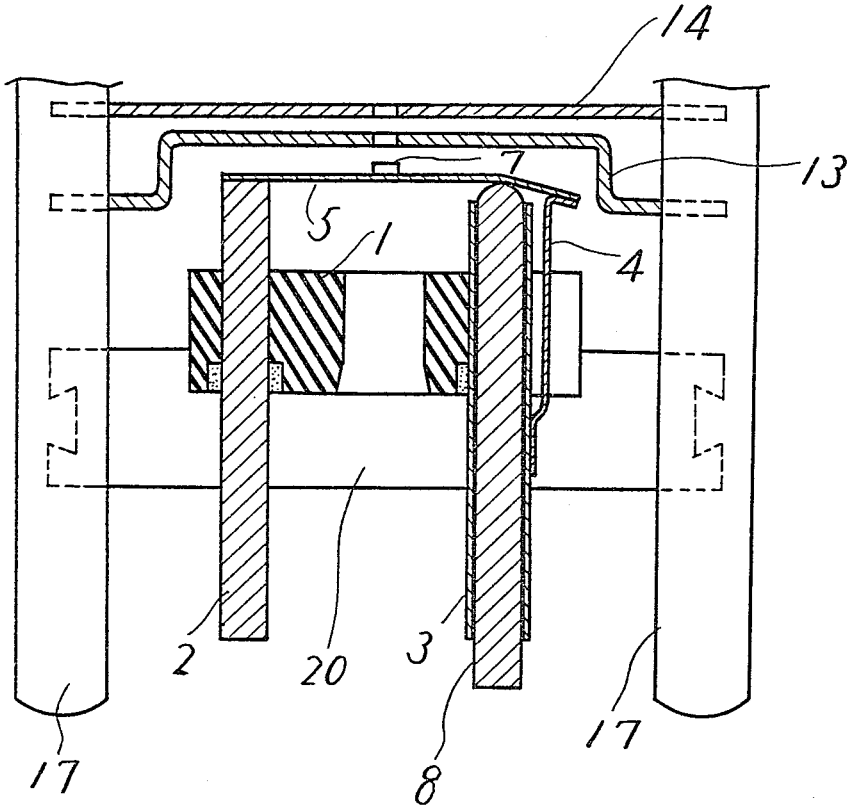
FIG. 3 shows a section of an essential part of the electron gun shown in FIG. 2.

FIGS. 2A and 2B show a so-called in-line type electron gun assembly in which the three electron emitting members are disposed in one line.

In this in-line type electron gun assembly, direct heated cathode assemblies 20, first grid assembly 13, second grid assembly 14, third grid assembly 15 and fourth grid assembly 16 are fixed to two insulative supporting rods. In this gun assembly, third grid assembly 15 and fourth grid assembly 16 are common electrodes through the whole gun assembly, and are box type electrodes having electron beam apertures or holes. Second grid assembly 14 and first grid assembly 13 are plate-like electrodes and have three electron beam apertures, respectively. The direct heated cathode assembly 20 is provided with filaments 5 stretched between supporting members 2 and 3 which are located oppositely in a substrate 1 and an electron emitting member 7 is secured to the filament 5. FIG. 2A is a partly sectioned schematic view of the electron gun assembly according to this invention, and illustrates the electron gun assembly in which the direct heated cathode assembly 20 comprises the electron emitting members 7 disposed centrally on the filament 5 stretched between supporting members 2 secured to the substrate 1, and hollow supporting members 3 through which a movable member 8 is inserted, and the hollow supporting members 3 being secured on their outside surface to a resilient support member 4, and the first grid assembly 13 being disposed adjacently to the cathode assembly and the second grid assembly 14 being mounted securely with insulative supporting rods 17.

Figure 4:
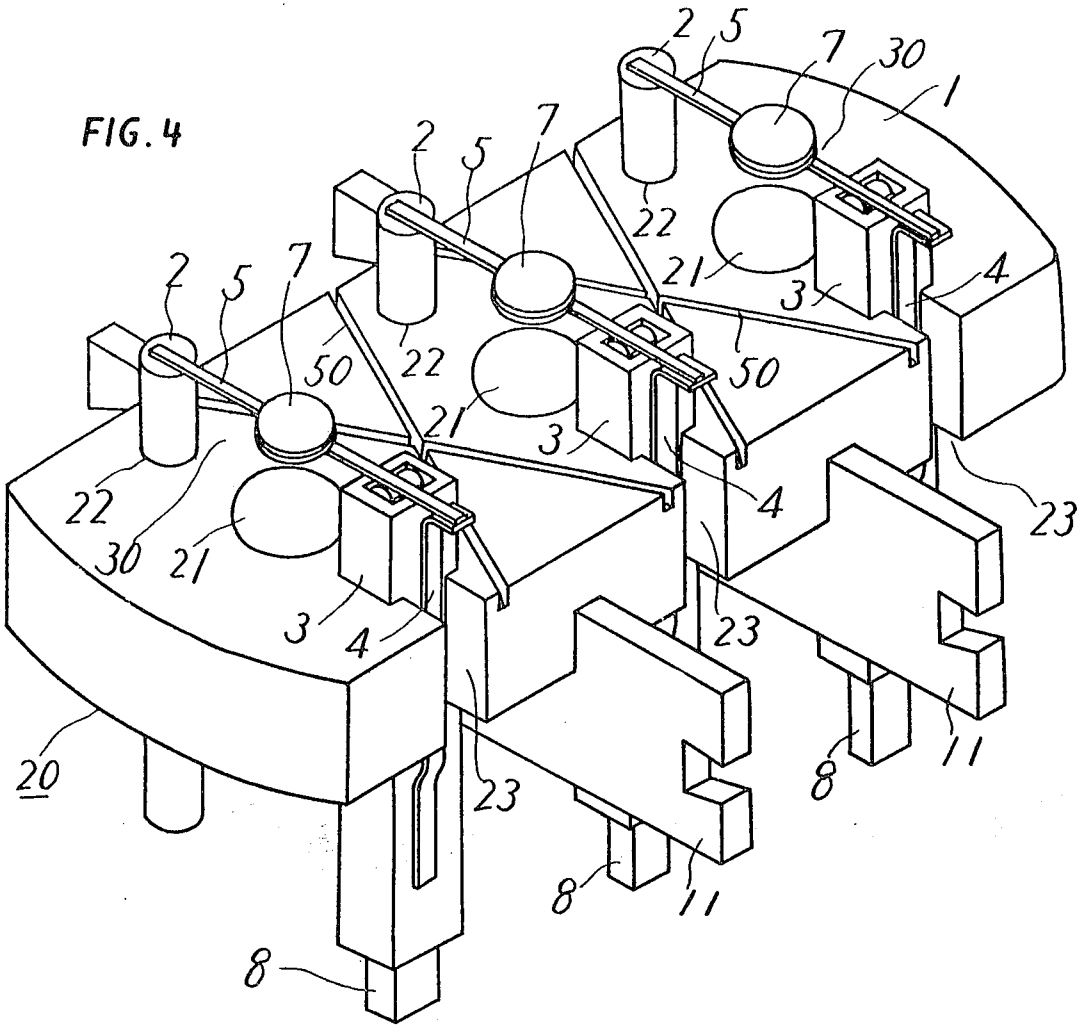
FIG. 4 shows a diagonal view seen from an upward direction of the direct heated cathode shown in FIG. 3.
Figure 5:
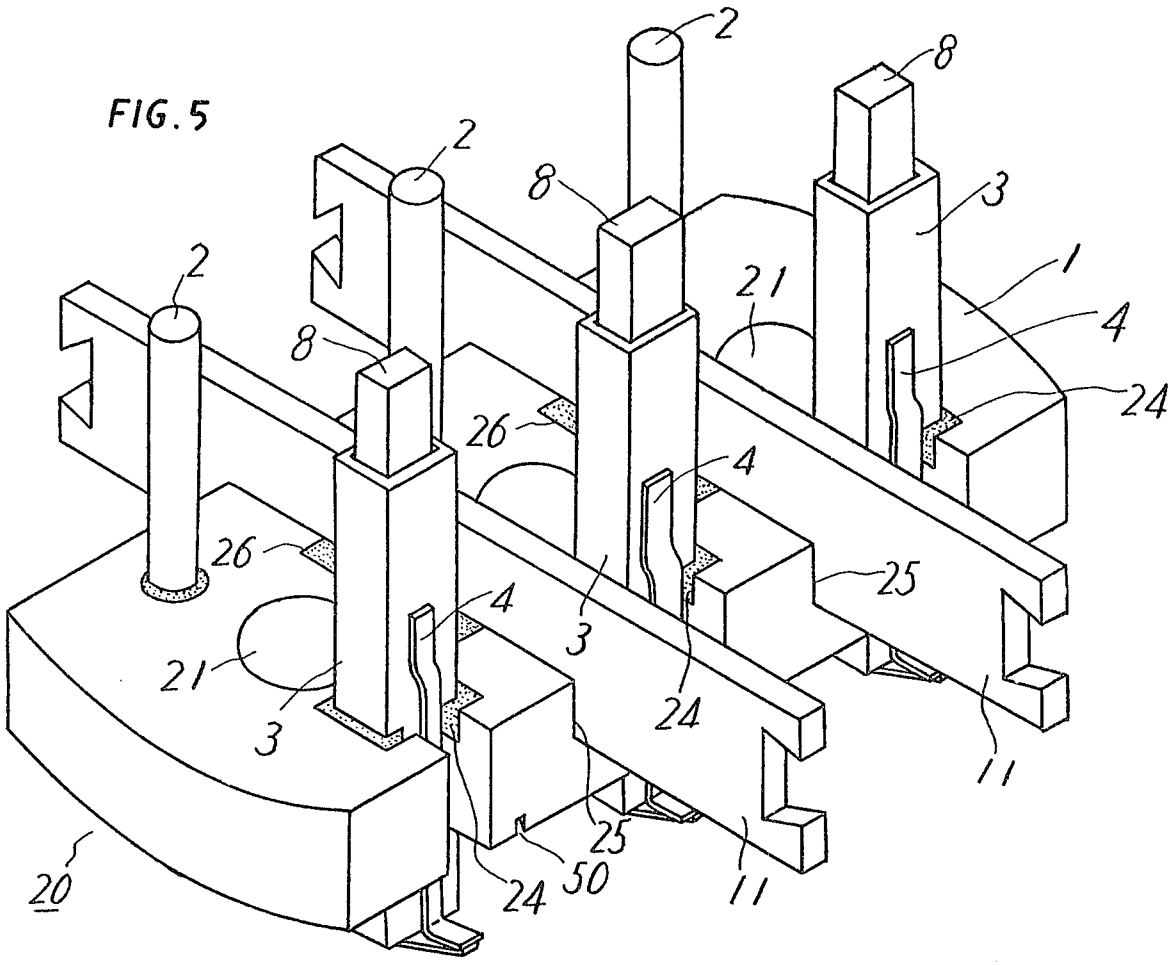
FIG. 5 shows a diagonal view seen from a downward direction of the direct heated cathode shown in FIG. 3.

The construction of a cathode assembly according to the invention is now more precisely described with reference to FIG. 4 and FIG. 5.

The direct heated cathode assembly according to the invention comprises three direct heated cathodes 30, each comprising a pair of supporting member 2 and 3 passing through and supporting by an insulative substrate 1 of ceramics or the like, resilient members 4 secured to the supporting members (3), filament 5 stretched between two supporting members, electron emitting member 7 securely mounted on the filament 5 and a movable member 8 which is able to readjust the spacing between electron emitting member and the first grid electrode. The substrate 1 has a plurality of through-holes 22 and grooves supporting three pairs of supporting members 2 and 3. These through-holes 22 and grooves 23 have a space which is provided to accommodate adhering material or frit glass securing the supporting members 2 and 3 to the substrate 1 (spaced portions for adhering material located at through-hole side are not shown). Through-holes 21 are provided in the middle portion between through-holes 22 and grooves 23, which holes 21 are aligned with the electron emitting members respectively. Isolating grooves 50 are provided in the upper surface of the base plate to isolate supporting members. Slits 25 are provided on the lower surface of substrate 1 to fit supporting plates 11. The central portion of the slit 25 has a depression 26 to receive frit glass (see FIG. 5).

Figure 6:
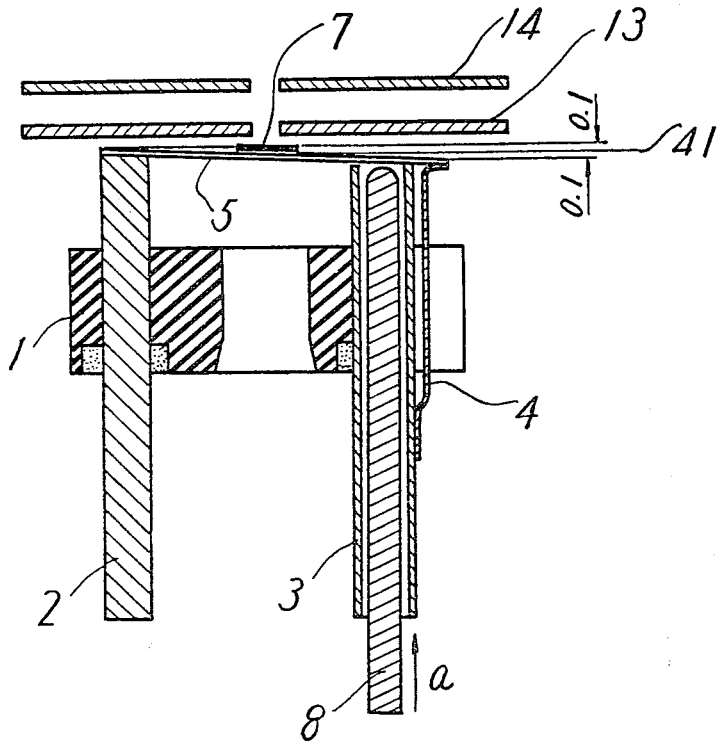
FIG. 6 shows an assembling process of the electron gun according to this invention.

One supporting member 2 of the paired supporting members 2, 3 disposed in the substrate 1, as seen above, fixedly supports one end of filament 5 carrying electron emitting member in the central portion thereof, and the other supporting member 3 resiliently supports the other end of the filament. The other end of the filament is extended in the outside of the supporting member 3 and secured to the resilient member 4 secured to said outer side of the supporting member 3. The supporting member 3 is provided as a rectangular hollow member to guide a movable member 8 which enables adjustment of the height of electron emitting member by contacting it to the filament, to bring cathode and first grid spacing (abbreviated "$G_1K$ spacing" hereinafter) into a predetermined value. The supporting member 2 which is secured to one end of the filament 5 as described above (hereinafter called "fixedly supporting member") is inserted into through-hole 22 and secured to the substrate 1, and the supporting member 3 which is provided with the movable member 8 and resilient elastic member 4 which are intended to readjust $G_1K$ spacing (hereinafter called "adjustable supporting member") is inserted to the groove 23 in the substrate 1 and secured with adhesives. The resilient member 4 which is secured at one end thereof to the adjustable supporting member 3 supports the filament 5 at another end thereof and serves to absorb thermal expansion when heated with electric current or to give resilient force to the filament as to enable displacement of the filament 5 when its location is adjusted. Electron emitting member 7 comprises a cathode base metal comprising essentially of nickel including a slight quantity of magnesium, silicon or the like, which metal is coated with an electron emissive coating such as $(Ba, Sr, Ca)Co_3$. Movable member 8 serves to readjust and maintain the spacing between electron emitting member 7 and a first grid to a predetermined value, and after the plurality of grid assembly and the substrate are assembled with insulative supporting rods, the movable member 8 is inserted into the adjustable supporting member 3 and is guided by the member 3 to readjust the location of the electron emitting member. As seen from FIG. 6, disposition of the top of each supporting members 2 and 3 from the upper surface of the substrate 1 are predetermined such that the securing portion of filament 5 with resilient member 4 secured to the adjustable supporting member 3 is lower than that of the fixedly supporting member 2 by about 0.1 to 0.15 mm. Accordingly, the filament 5 mounted between fixedly supporting member 2 and resilient member 4 are not in parallel with the substrate 1 or first grid assembly 13.

Assembling of the aforementioned electron gun assembly will be described in the following. At first, a plurality of grid electrodes including first and second grid electrode assemblies 13 and 14 and direct heating type cathode assembly 20 are assembled integrally with insulative supporting rods (not shown) by embedding electrodes therein, in a predetermined spacing therebetween. Then the lower end of the filament 5 is brought into contact with the top end of the movable member 8 and the movable member is moved upwardly to bring filament in parallel with first grid assembly. In this case, the adjustment is carried out measuring $G_1K$ spacing by means of optical or electrostatic method or the like by using first or second grid electrode as a standard surface. After adjusting $G_1K$ spacing to the predetermined value by means of moving the movable member 8 and adjusting the location of electron emitting member with respect to the first grid assembly, the movable member 8 is secured to the adjustable supporting member by means of spot welding method, and one end of filament 5 is supported by the upper end of the movable member. Theoretically, the most desirable assembled form of cathode and grid is that they are in parallel relationship. In practice, after the readjustment of $G_1K$ spacing by means of the movable member 8, substantial parallelism between cathode and first grid electrode is not necessarily obtained because of the disposed spring forces in each filament 5 or the dimensional dispersion of the fixedly supporting member height. Practically, because the diameter of first grid aperture which effects electron emission is as small as 0.5 to 0.8 mm and that the correct $G_1K$ spacing is obtainable by measuring it through the aperture, deviation from parallelism does not affect practically to the electron gun characteristics.

In the case when the upper surface of the end portion of the filament 5 connected to the fixedly supporting member is deviated from the basic plane 41 disposed at the portion which is spaced from the first grid in a predetermined $G_1K$ spacing, filament 5 may be stretched somewhat obliquely because the electron emitting member is maintained by means of measurment of $G_1K$ spacing at the portion just below the first grid aperture. The designing aim of the mobility of the filament at the contact point with movable member is considered to a distance range of $\pm 0.1$ mm, and the readjustable range of $G_1K$ spacing at the electron emitting member becomes practically half of this value because the electron emitting member is disposed in the middle portion of the filament. Considering from the upper described readjustable range of $G_1K$ spacing, it is possible to maintain $G_1K$ spacing at a predetermined value regardless of assembling error of fixing the fixedly supporting member to the substrate or error of parallelness between each beam aperture, or height error of electron emitting member caused from an assembling process of direct heated cathode. In this way, the electron gun assembly according to this invention is able to readjust the $G_1K$ spacing upon measuring it after assembling a plurality of grid electrode assemblies and the direct heated cathode assembly with the insulative supporting rods, and is able to provide the electron gun assembly having precise $G_1K$ spacing.

Figure 7B:
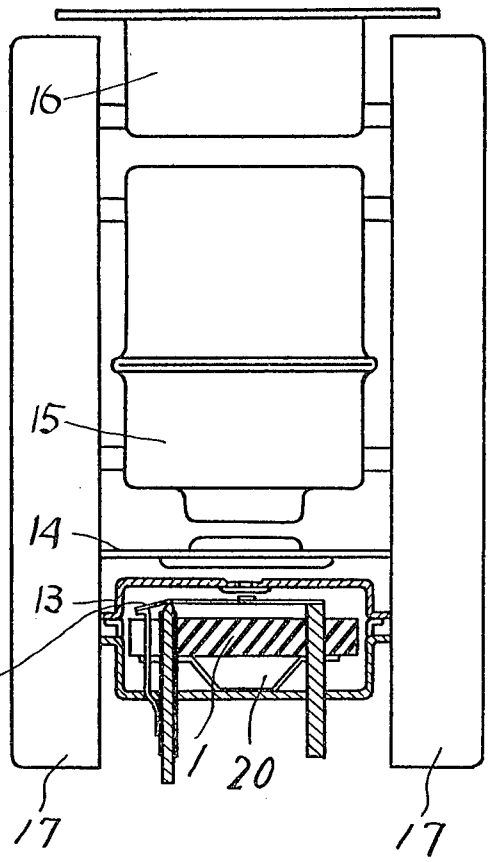
FIGS. 7 (A) and (B) show respectively a partly eliminated elevational and side view of an electron gun of a modified embodiment according to this invention.
Figure 7A:
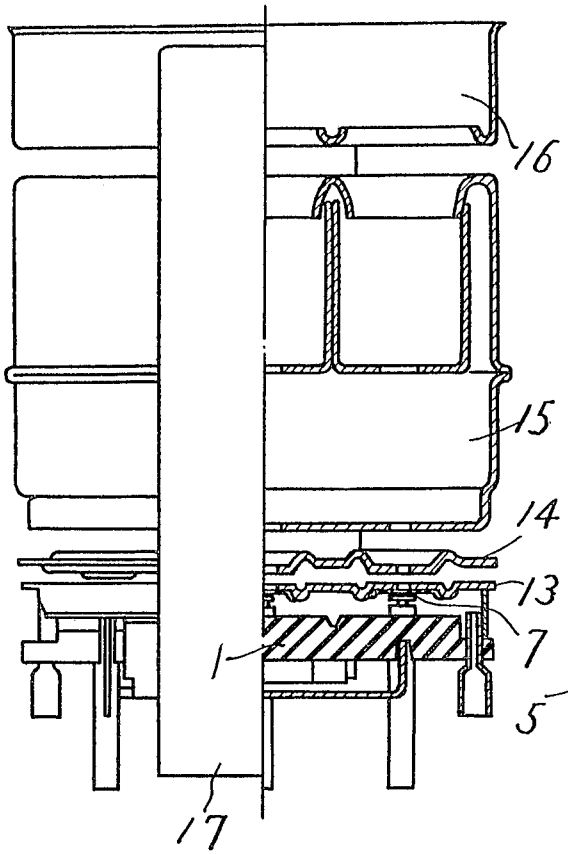

Another embodiment will be described hereinafter. In FIGS. 7A and B, a direct heated cathode assembly 20 including three electron emitting members 7 each mounted on filaments 5 respectively is fixedly mounted with first, second, third and fourth grid electrodes 13, 14, 15 and 16 in a predetermined geometry by means of a pair of insulative supporting rods oppositely disposed with each other. The fourth grid electrode 16 and the third grid electrode 15 are common to three electron guns and are box-like electrodes having three electron beam apertures or holes, and the first and second grid electrodes 13 and 14 are flat shaped electrodes having three electron beam apertures.

This type of electron gun assembly is shown more precisely in FIG. 8 (A), (B), (C) and (D). In FIGS. 8A–8D, numeral 20 defines a direct heated cathode assembly having three direct heated cathodes 30 on a substrate 1. In this cathode assembly, a first grid electrode 13 and a cathode retainer 28 is fixed in an opposite side of the cathode assembly. Direct heated cathode 30 includes a filament 5 stretched between fixedly supporting member 2 and adjustable supporting member 3 with resilient member 4, electron emitting member 7 secured to the filament and a movable member 8 inserted in and then fixed to the adjustable supporting member 3. The first grid electrode is a substantially rectangular flat type electrode having rounded shorter sides and has three electron beam apertures disposed in line with its longitudinal central line. Beads 134 are provided to eliminate deformation of the electrode and also to eliminate interferences between two adjacent electron beams. In the long sides of the electrode there are bead straps 132 to be embedded into insulative supporting rods or bead glass. The first grid of this type defines the spacing between the electrode and the electron emitting member 7 by means of two $G_1K$ spacers provided in both longitudinal ends of the substrate, and is connected to a retainer 28, which has welding ears 280 to connect first grid electrode, straps 281 to be embedded into insulative supporting rods or bead glasses and fixing ears 282 to fix the retainer to the substrate 1. Between the retainer 28 and the lower surface of the substrate, there is a spring 34.

In the following, detailed description of the electron gun assembly illustrated in FIGS. 8A–8D will be made with reference to FIG. 9 to FIG. 14.

Figure 9:
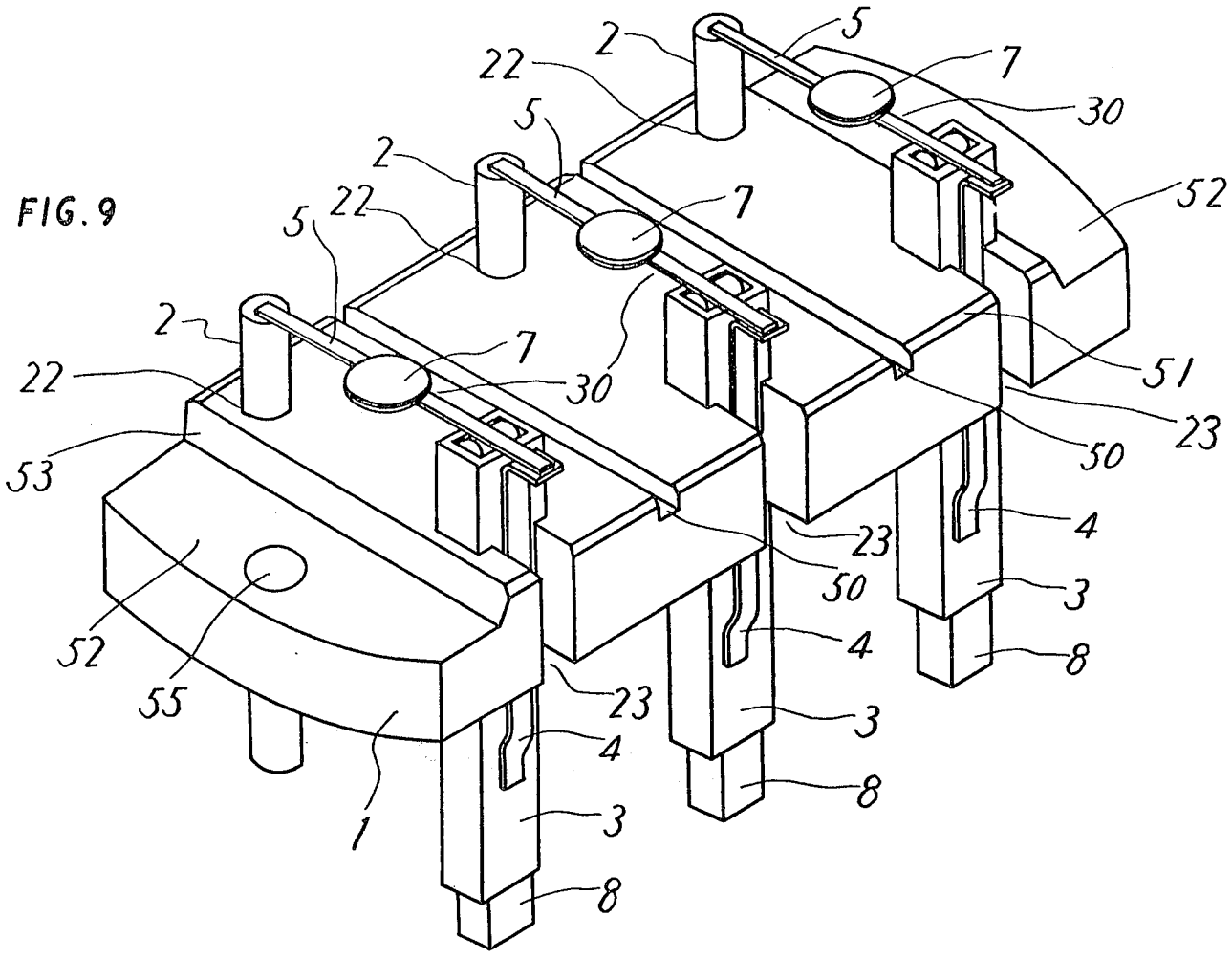
FIG. 9 is a diagonal view seen from an upward direction of the direct heated cathode shown in FIG. 8.
Figure 10:
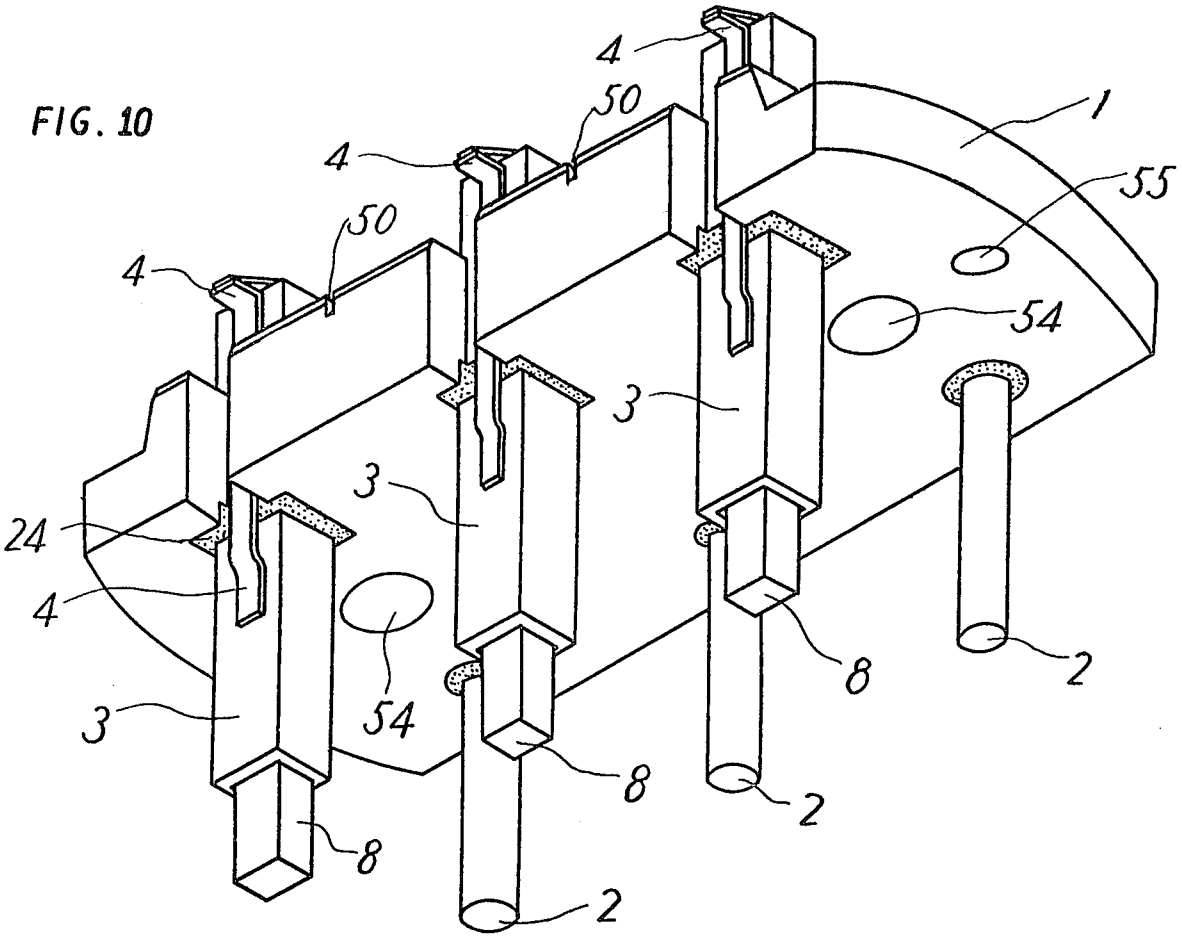
FIG. 10 is a diagonal view seen from a downward direction of the cathode shown in FIG. 8.

In FIG. 9 and FIG. 10, numeral 1 denotes an insulative substrate of, for example, ceramics, provided with three apertured hole 22 and three slots or grooves 23 to support three fixedly supporting members 2 and three adjustable supporting members 3 which are oppositely disposed with respect to the beam apertures of the first grid electrode. In the inside of the through-holes 22 and slots or grooves 23, spaces 24 are provided to accommodate frit glass which fixedly connects supporting members 2 or 3 to the insulative substrate 1 after fitting the supporting member into holes or slots (The spaces for fixedly supporting members are not shown). In the upper surface of the insulative substrate 1, between each of the pairs of supporting members, isolating grooves 50 extending transversely to the substrate are provided to isolate respective cathodes 30.

The insulative substrate 1 has an inclined face 51 along its longitudinal side and has a pair of steps 52 near both longitudinal ends thereof and tilted surface 53 are provided between the steps and upper surface of the base plate. The grooves 50 and inclined face 51 and 53 are provided to provide shadowed face for evaporated materials from high temperature operable members such as electron emitting member, and their tilt angles and location may be determined to provide good shadow for this purpose. In the other words, to make a discontinuity in the evaporated film from, for example, electron emitting member on the substrate, these grooves or tilted portions are provided. In the stepped portion 52 of the substrate 1, through-hole 55 is provided to fix $G_1K$ spacer as shown in FIGS. 12A to 12C to define the spacing between electron emitting member and first grid electrode, and in the lower surface of the substrate, a depression 54 is provided to fix the retainer. The fixedly supporting member 2 which constitutes one of the paired supporting members disposed separately in a predetermined distance, and embedded through the substrate, fixedly supports one end of the filament having in its central portion the electron emitting member. The adjustable supporting member 3 supports resiliently the filament 5 by means of connecting the other end of the filament 5 to a resilient member 4 secured to the adjustable supporting member 3. The adjustable supporting member is of hollow-centered rectangular sleeve like metal, and guides the movable member 8 to adjust the height of the filament by contacting to the filament. The fixedly supporting member 2 is secured to the through-hole 22, and the adjustable supporting member 3 having elastic member 4 and movable member 8 which are to adjust relationship between first grid and cathode, is fit and secured to the groove 23 of the substrate. The resilient member 4 is provided to fix and support one end of the filament 5 and is secured to the adjustable supporting member 3 to effect a resilient tensile force to the filament and absorbs thermal elongation when heated by electric current, or to be able to readjust location of the filament 5 when adjusting the location of electron emitting member by means of movable member 8. Electron emitting member 7 comprises a cathode metal of nickel alloy containing nickel, magnesium and silicon and an electron emissive coating containing (Ba Sr Ca)$Co_3$ or the like coated on the upper surface of the cathode base metal.

As is more clearly shown on FIGS. 11A–11C, retainer 28 has a lower body portion 283, two fixing lugs or ears 282 bent substantially at right angles with respect to the body portion 283 and to be inserted in the setting hole provided at a rear surface of the substrate 1 (not shown), welding lugs or ears 280 to be fixed to the first grid (not shown) and straps 281 to be embedded to insulative support members (not shown).

As shown in FIGS. 12A–12C, $G_1K$ spacer 32 has a tubular portion 320 to be inserted into the through-hole 55 and fixed thereto and a curved plate-like portion 321 secured to the upper part of the tubular portion.

Assembling of the aforementioned gun will be described hereinunder with respect to FIGS. 8A–8D of the drawing. FIGS. 8A–8D shows a preassembled combination of cathode and first grid. Under this circumstance, the geometries of electron emitting members 7 supported on the substrate 1 and of the beam apertures of the first grid 13 include some deviations or tilt from the predetermined or ideal geometries thereof owing to warp or non-flatness caused by press operation, demensional variation of the supporting members caused by the solidifying of glass used as the adhering material therefor, deformation of welded parts of filament and supporting membrane, filament sagging, or uneven or unequal coated thickness of the electron emissive material. In a single electron gun type mount, the $G_1K$ distance can be easily realized by using a $G_1K$ spacer having a height equal to the sum of the predetermined $G_1K$ spacing and the height of the electron emitting member from the substrate. However, in the three gun type electron gun assembly, to equalize distances between the substrate and the electron emitting member (hereinafter called cathode height) of three electron guns is very difficult. Even if the cathode assembly having equal cathode height is obtained, it is almost impossible that each cathode height may be combined to each aperture of the first grid when the first grid electrode has some unevenness between the three apertures. In FIGS. 8A–8C, a process which can correctly adjust each $G_1K$ spacing by means of movable member 8 after preassembly of the cathode and first grid is shown.

At first, cathode heights of each three electron gun assembly are measured separately. Cathode height of each cathode need not necessarily coincide with each other, but in general, dispersion or deviation from the designed value of cathode height should have a value smaller than the adjustable value which has been described before. Suitable value of cathode height depends on designed value of $G_1K$ spacing and the distance between the $G_1$ electrode and the substrate 1 determined by the $G_1K$ spacer 32.

Next, the $G_1K$ spacer 32 is fixed to the substrate 1 mounting the direct heated cathodes thereon through the sleeve members 320, which is inserted into the through-holes 55 and is pinched at the end. Because of the slope portion 53 formed at the step portion 52 of the substrate 1, the $G_1K$ spacer 32 would not touch the upper surface of the substrate 1. Even if the vapored film of the electron emitting material is formed on the surface of the substrate, the $G_1K$ spacer 32 never contacts the filament 5 electrically. Similarly, the groove 50 and the slope portion 51 of the substrate 1 maintain the insulation between the $G_1$ electrode and the respective cathodes high.

The strap 132 of the $G_1$ electrode 13 put on the $G_1K$ spacers 32 and the welding ear portion 280 of the cathode retainer 28 disposed on a opposite side of the substrate 1 are welded together. The spring 34 disposed between the substrate 1 and the retainer 28 fixes the $G_1$ electrode 13 to the substrate 1 firmly. In this welding process, the retainer 28 is set on the position where the fixing ear 282 is inserted into the hole 54 of the substrate 1, and the $G_1$ electrode 13 is set in order that respective apertures of the $G_1$ electrode are opposite to the respective electron emitting members.

After assembling the direct heated cathodes assembly, respective spacing between the $G_1$ electrode 13 and the electron emitting members 7 are adjusted by moving the movable members 8 of the adjustable support members 3 toward the $G_1$ electrode 13. The $G_1K$ spacing is measured by an optical measuring apparatus or an air-micrometer during adjusting the spacing. As the value of the spring is nearly equal to the predetermined value without adjustment, this adjustment merely compensates the deviation among the $G_1K$ spacings of three electron guns.

By using the $G_1K$ spacers 32 disposed on the substrate 1 and by putting the $G_1$ electrode 13 on the $G_1K$ spacers 32, the $G_1K$ spacing can be coarsely defined to the predetermined value. And by using the adjusting means, the $G_1K$ spacing can be more accurately established.

The $G_1$ electrode comprises a plane portion and two side wall portions. and the $G_1K$ spacer 32 comprises the curved plate-like portion 321. The plane portion and two side wall portions of the $G_1$ electrode and the curved portions 321 of two $G_1K$ spacers form a substantially box-like compartment in which electron emitting members are disposed. Accordingly these portions and members act effectively as a shield for leaking electrons.

This preassembled cathode sub-assembly, the $G_2$ electrode 14, the $G_3$ electrode 15 and the $G_4$ electrode 16 are secured to the heated glass rods with a predetermined distance from each other. The electron gun assembled in this way provides, a good focus characteristic without readjustment.

Figure 13:
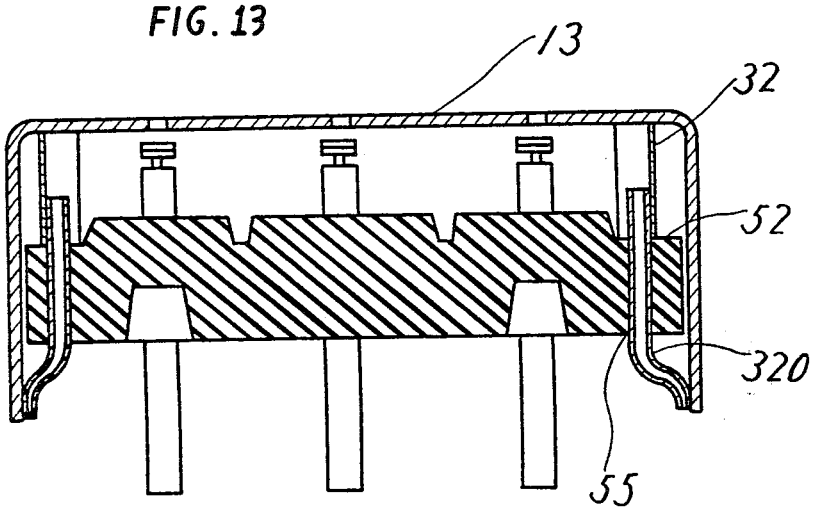
FIG. 13 shows a cross sectional view of the electron gun assembly according to the modified embodiment of the present invention.

Another modification of the second embodiment of this invention is shown in FIG. 13. In this modification, the $G_1$ electrode 13 includes a flat portion and a sleeve like portion is disposed on the substrate to cover it, and is welded to the tubular portion 320 of the $G_1K$ spacer 32 at the opposite side of the substrate 1, which is inserted into the through-hole 55 and is pinched and is bent to be fixed to the substrate 1 at the outlet of the through-hole 55.

Figure 14A:
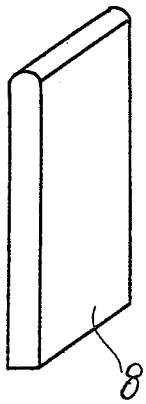
FIG. 14 to FIG. 18 illustrate respectively different types of movable members shown in FIG. 4 and FIG. 9.
Figure 14B:
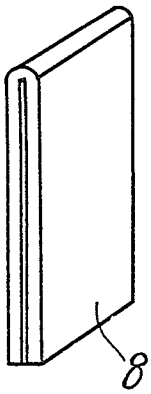
Figure 14C:
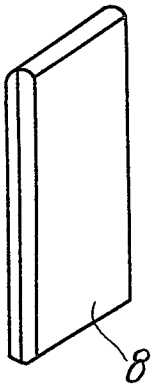
Figure 15:
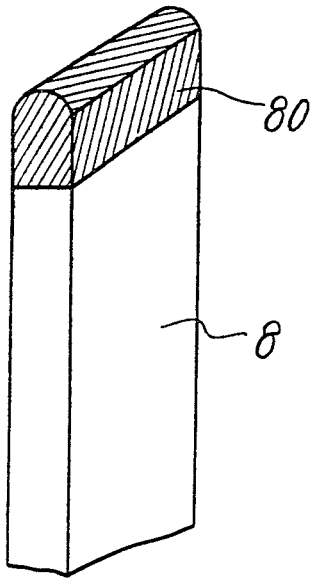

Referring to FIGS. 14A–14C, detail of the movable member is described below. The movable member 8 is one of the adjusting means for the spacing between the $G_1$ electrode 13 and the electron emitting member 7. The movable member 8 is disposed in the hollow shaped adjustable support member 3. In order to adjust the $G_1K$ spacing, the movable member 8 is moved inside the adjustable support member 3 toward the $G_1$ electrode 13 to push up the filament 5. So, the movable member 8 is shaped round at the top portion not to cut the filament 5.

The movable member 8 has an oxide layer of chromium or aluminum at the point of contact with the filament, to increase the contact resistance between the filament and movable member 8 as compared with the resistance of the filament 5 and the resilient support member 4.

In this invention, the contact resistance between the filament 5 and the movable member 8, is designed to be substantially larger than the resistance of the filament 5 and the resilient support member 4, because, if the contact resistance is low comparatively, the filament current is changed easily owing to the change of the contact resistance caused by the change of the contact pressure or the contact area. The change of the filament current affects the electron emitting characteristic. The deviation between the electron emitting characteristics of the three electron guns makes it hard to adjust the white-balance in a color cathode ray tube. Furthermore, the low contact resistance promotes additional drawbacks.

Some examples of the movable member 8 having an oxide layer of chromium are shown in FIG. 15, FIG. 16, FIG. 17 and FIG. 18. The example shown in FIG. 15 has an oxide layer of chromium 80 at the whole surface of the portion with which the filament 5 is in contact. This movable member is produced by firing the movable member plated with chromium in wet hydrogen atmoshere at 1200° C. The oxide layer of chromium has a higher surface resistance more than 1 mega-ohms/□, and would not be shaved by rubbing.

Figure 16:
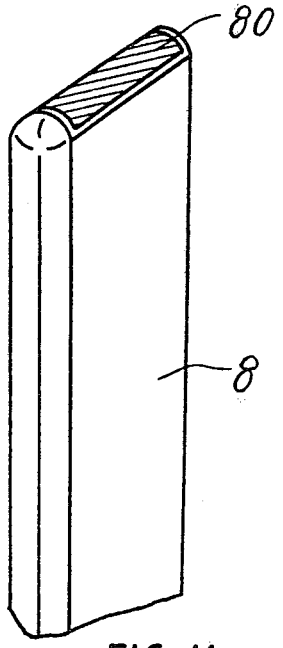

The example shown in FIG. 16 has three layered structure in which the middle layer is of chromium alloy. The oxide layer of chromium is formed on the chromium alloy layer at the portion of the movable member 8, which is not covered with another metal layer.

Figure 17:
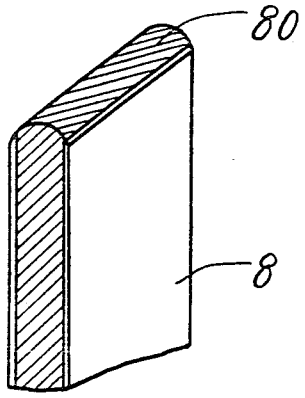

The example shown in FIG. 17, similar to that shown in FIG. 16, has a laminated structure and has an oxide layer of chromium at the side portion of the movable member.

Figure 18:
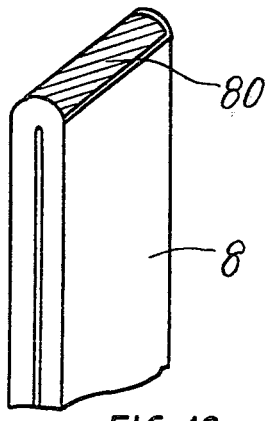

The example shown in FIG. 18 is formed by bending a strip and making thereafter an oxide layer of chromium on the bent portion, where the filament is contacted.

In short, it is desired that the movable member has a high resistance portion in electric conductivity and thermal conductivity, which portion is in contact with the filament and another portion with which welding to the adjustable support member is done.

In this invention, an oxide layer of aluminum can be used instead of the oxide layer of chromium.

As the resistance of the filament is 1.5 ohms and the resistance of the support member is 0.2 to 0.3 ohm in the typical embodiment of this invention, preferably, it is desired that the contact resistance between the filament and the movable member is 3 orders as large as the resistance of the support member.

What is claimed is:

1. An electron gun assembly for cathode ray tubes comprising:

a plurality of glass rods;

a plurality of apertured grid electrodes, including a first grid electrode having an aperture therethrough;

a cathode substrate;

a plurality of direct-heated cathodes mounted on said substrate, said substrate and said grid electrodes supported and separated from each other by the glass rods, each of the cathodes including a pair of spaced apart support members, a filament connected at its opposite ends to the support members and stretched between said support members and an electron emitting member disposed on the filament between the ends thereof in a position aligned with the aperture in the first grid electrode and spaced a predetermined distance therefrom;

wherein one of each of the paired support members comprises movable adjusting means contacting a respective filament for adjusting the spacing of the filament and the electron emitting member relative to the first grid electrode, thereby precisely establishing the spacing between each electron emitting member and the first grid electrode.

2. An electron gun assembly according to claim 1, wherein the adjusting means comprises:

resilient support members connected with a respective filament at one end thereof;

movable members in contact with a respective filament for changing the position of the electron emitting member; and guide members guiding a respective movable member when it moves.

3. An electron gun assembly according to claim 2, wherein each movable member has an oxide layer of chromium or aluminum at the portion where the filament is in contact therewith, thereby increasing the contact resistance between the filament and the movable member as compared with the resistance of the filament and the elastic support member.

4. An electron gun assembly according to claim 1, wherein a plurality of grooves are formed on the upper surface of the substrate.

5. An electron gun assembly according to claim 1, wherein the substrate comprises a spacer setting up the spacing between the electron emitting member and the first grid electrode.

6. An electron gun assembly according to claim 1, wherein the substrate has a retainer at the lower surface thereof through a resilient member.

7. An electron gun assembly according to claim 1, wherein three direct heated cathodes are brought into line so as to form an in-line type electron gun assembly.

8. A method of assembling an electron gun assembly for cathode ray tubes having a plurality of apertured grid electrodes and direct heated cathodes fixed and separated at a predetermined distance from each other by a plurality of glass rods opposed to each other, comprising the steps of:

mounting on a substrate a pair to three pairs of support members and a spacer setting up the spacing between an electron emitting member and a first apertured grid electrode;

fixing one end of a filament to one of the support members and resiliently fixing the other end of the filament to the side end of the other support member such that a tensile force is applied to the other filament end;

maintaining the spacing between the substrate and the first grid electrode at a predetermined value through the spacer;

disposing a retainer on the lower surface of the substrate;

securing the first grid electrode to the retainer;

setting the filament to a predetermined position by moving the resiliently fixed other filament end by contact with a moveable portion of the other support member in order to adjust the spacing between the first grid and an electron emitting member mounted on the filament;

fixing the electron emitting member to a predetermined position after adjusting the spacing between the first grid and the cathode; and securing the grid electrodes and the cathode to the glass rods with a predetermined distance from each other.

* * * * *